United States Patent [19]

Maruska et al.

[11] Patent Number: 4,770,096

[45] Date of Patent: Sep. 13, 1988

[54] SAFING AND ARMING MECHANISM

[75] Inventors: William O. Maruska, Minnetonka; Mark A. Bayerkohler, Brooklyn Center, both of Minn.

[73] Assignee: Honeywell Inc., Minneapolis, Minn.

[21] Appl. No.: 85,688

[22] Filed: Aug. 17, 1987

[51] Int. Cl.[4] ..... B41F 5/02

[52] U.S. Cl. ..... 102/229; 102/233; 102/235; 102/254

[58] Field of Search ..... 102/235, 229, 223, 233, 102/254

[56] References Cited

U.S. PATENT DOCUMENTS

| | | | |
|---|---|---|---|
| 2,737,890 | 3/1956 | Brode | 102/235 |
| 3,603,259 | 9/1971 | Webb | 102/235 |
| 3,779,169 | 12/1973 | Backstein et al. | 102/229 |
| 3,802,344 | 4/1974 | Laipple | 102/229 |
| 4,090,450 | 5/1978 | Nygards | 102/254 |
| 4,691,634 | 9/1987 | Titus et al. | 102/229 |

*Primary Examiner*—David H. Brown

*Attorney, Agent, or Firm*—E. W. Hughes; R. W. Jensen

[57] ABSTRACT

A safing and arming (S&A) device 20 for a spin stabilized projectile 16 having an electronic fuzing system 18 which produces an electrical arming signal after the projectile 16 is fired. The cylindrical S&A housing 26 has two faces 28, 30 and a blow through hole 32 through the center of housing 26. A barrier recess 34 is formed in one face 28 of the housing 26 and a detonator 40 is mounted on the other face 30 and in alignment with the blow through hole 32. A barrier 36 is pivotally mounted in the barrier recess 34. Barrier 36 is held in its safe position blocking blow through hole 32 by a set back tab 54 and a barrier latch 48. The set back tab 54 is rendered inoperative when projectile 16 is fired from a gun. Latch 48 is bent out of contact with barrier 36 by a pyrotechnic actuator 56 being activated by the arming signal. When latch 48 is disengaged from the barrier 36, barrier 36 is free to move to its armed position, in which barrier 36 no longer blocks blow through hole 32. Barrier 36 is moved by centrifugal force as a result of the projectile spinning about its spin axis.

14 Claims, 1 Drawing Sheet

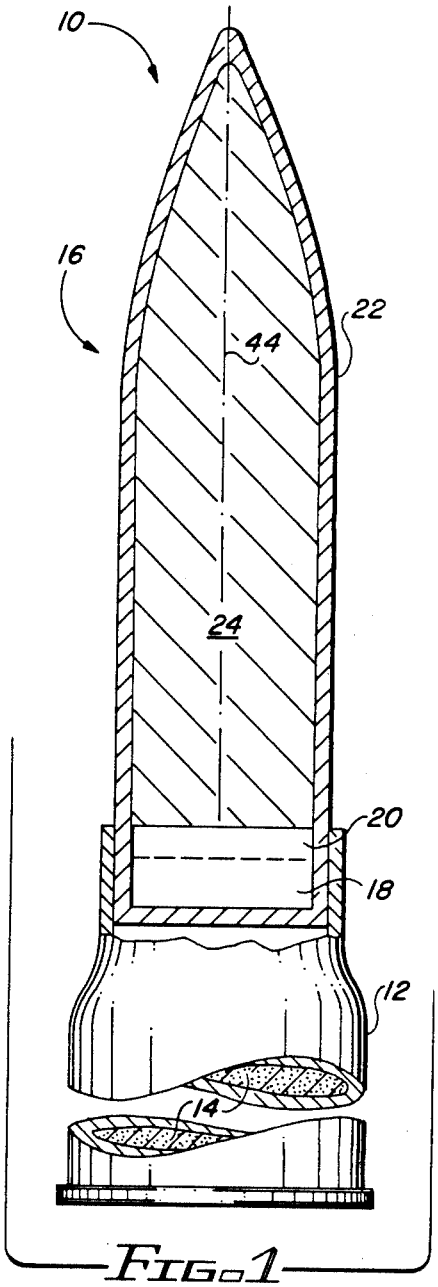
FIG. 1
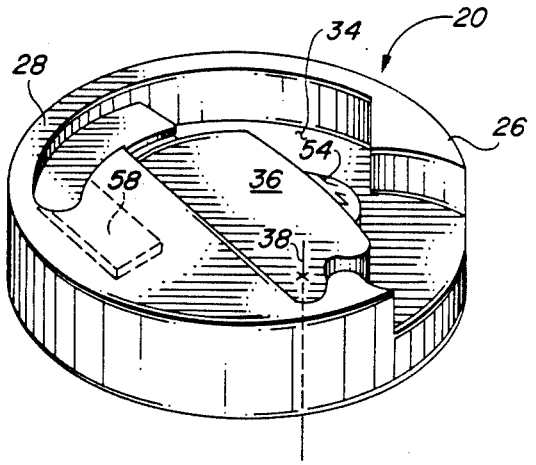
FIG. 2
FIG. 3
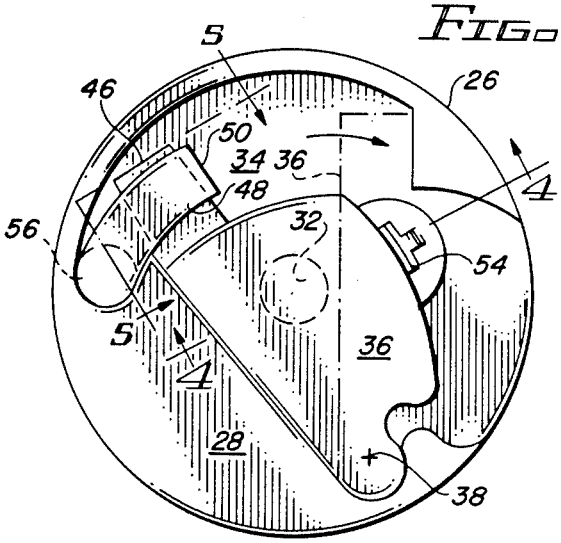
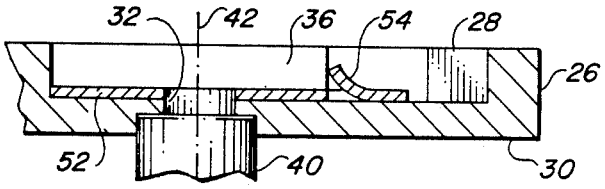
FIG. 4
FIG. 5
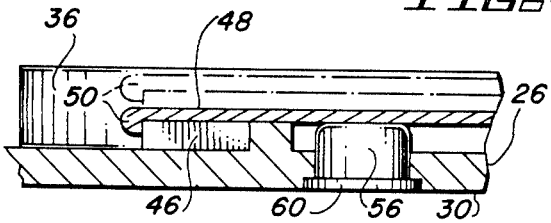
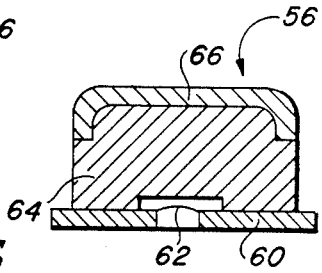
FIG. 6

SAFING AND ARMING MECHANISM

The Government has rights to this invention pursuant to Contract No. F08635-85-C-0151, awarded by the Department of the Air Force.

CROSS REFERENCE TO RELATED APPLICATION

The following application, "Detonator" by Mark A. Bayerkohler and William O. Maruska, Ser. No. 07/085,921 filed Aug. 17, 1987 the disclosure of which is hereby incorporated by reference into this application, was filed concurrently with this application. Both applications are assigned to the same assignee.

BACKGROUND OF THE INVENTION (1) Field of the Invention

This invention is in the field of Safing and Arming (S&A) devices for spin stabilized electronically fuzed projectiles containing a high explosive bursting charge such as are fired from a rapid fire gun.

(2) Description of the Prior Art

To increase the effectiveness of smaller caliber, such as 20–30 mm, projectiles fired from rapid fire guns mounted on aircraft, helicopters and ground vehicles, projectiles of such caliber have been developed which include a high explosive bursting charge located within the casing of the projectile. Electronic fuzing systems for such projectiles have also been developed to complete the firing train of the projectile, or arm the projectile, when certain predetermined conditions have been satisfied such as the passage of a predetermined period of time since the projectile was fired. In addition, such fuzing systems have the capability of sensing when the projectile strikes a target so that the fuzing system can produce a firing signal to initiate a detonator which when the firing train between the detonator and the bursting charge is unobstructed, or complete, causes the bursting charge of the projectile to detonate or explode a predetermined period of time after the projectile hits the target. This delay is intended to permit the projectile to penetrate into the interior of the target, such as an aircraft, to inflict maximum damage.

Because of the limited volumetric capacity of small caliber projectiles it is improtant that the volume required by the safing and arming device of each projectile be minimized. It is also important that the firing train of the projectile is manufactured, notwithstanding the thermal and electromagnetic environments and physical forces to which the projectile may be subjected during such period, until after the projectile is fired from a gun and the fuzing system of the projectile produces an electrical arming signal. The arming signal is normally produced when the projectile is clear of the platform on which the gun from which the projectile is fired so that the subsequent detonation of the projectile will not damage the platform from which it was fired or the crew serving such platform, or both.

SUMMARY OF THE INVENTION

The present invention provides a safing and arming (S&A) mechanism for a spin stabilized projectile containing a high explosive bursting charge, a component, or subsystem, or an electronic fuzing system which produces an electrical arming signal at a predetermined period of time after the projectile is fired. The predetermined period of time is determined so that the projectile will be clear of the gun from which it was fired and the platform on which the gun is typically mounted such as an airplane so that the subsequent explosion of the projectiles bursting charge will not damage the airplane from which fired.

The S&A mechanism includes a relatively thin substantially cylindrical housing which has two faces. The housing is positioned in the base of the projectile with the two faces of the housing substantially perpendicular to the spin axis of the projectile. A substantially cylindrical blow through hole is formed through the housing with the axis of the blow through the housing with the spin axis of the projectile. One side, the upper side of the housing for convenience, is in communication with the bursting charge of the projectile. An electrically initiated detonator is mounted on the other, or lower side of the housing. The function of the detonator is to produce products, gases, flames, and shock waves, when the detonator is detonated by a firing signal produced by the fuzing system. These products cause the bursting charge of the projectile to detonate when the firing train which includes, or extends, from the detonator to the bursting charge through the blow hole in the S&A housing is complete.

A barrier cavity, or recess, is formed in the upper surface of the S&A housing within which a safety barrier is pivotally mounted. The barrier has two positions, a safe position in which the safety barrier blocks the blow through hole, or stated another way interrupts the firing train, and an armed position in which the barrier is moved, pivoted in the preferred embodiment to one side, to unblock the blow through hole which arms the projectile. The safety barrier is provided with a safety arm which projects from the main body of the barrier remote from the pivot axis of the barrier. A barrier latch is mounted on the housing and the barrier latch in its safe position engages the safety arm of the barrier to maintain the barrier in its safe position. In addition, the housing is provided with a set back member positioned between the barrier and the base of the barrier cavity. A set back tab formed in the set back member engages a side of the barrier to maintain the barrier in its safe position until fired.

A pyrotechnic actuator is located in the housing and is positioned to force the barrier latch away from or out of restraining contact with the safety arm of the barrier when ignited by an arming signal produced by the fuzing system.

The set back tab and barrier latch prevent movement of the barrier from its safe to its armed position irrespective of the forces and conditions to which the projectile may be subjected short of its being fired from a gun. Any inadvertent firing of the detonator for any reason while the safety barrier is in its safe position and the firing train incomplete will not cause the bursting charge of the projectile to detonate. When a projectile which is provided with the S&A mechanism of this invention is fired, the large forces of acceleration to which the projectile is subjected will move the set back tab out of contact with the safety barrier and into substantial alignment with the balance of the material of the set back member in contact with the base of the barrier cavity.

While the projectile is subject to angular acceleration as well as linear acceleration as it traverses the length of a rifled gun barrel of the gun from which it is fired, the barrier latch retains the safety barrier in its safe position notwithstanding centrifugal force which tends to move the barrier to its armed position.

When the projectile has traveled a safe distance from the gun from which fired as well as the platform in which the gun is mounted, or after a predetermined period of time has elapsed since the projectile was fired as determined by the fuzing system, the fuzing system produces an electrical arming signal which detonates the pyrotechnic actuator. Detonation of the pyrotechnic actuator forces the barrier latch out of contact with the arm of the barrier, freeing the barrier to pivot from its safe position to its armed position. When the barrier is in its armed position the firing train from the detonator to the bursting charge through the blow through hole of the S&A housing is completed. As long as the projectile continues to rotate about its spin axis, centrifugal force acting on the safety barrier will cause the barrier to remain in its armed position. The projectile will explode when the fuzing system located in the base of the projectile produces a firing signal.

It is therefore an object of this invention to provide an improved S&A mechanism for a spin stabilized projectile fired from a gun.

It is another object of this invention to provide an improved S&A mechanism for a projectile the firing train of which is blocked by the safety barrier of the S&A mechanism of the fuzing.

It is yet another object of this invention to provide an S&A mechanism for a small caliber projectile having an electronic fuzing system that is small in size and reliable in operation.

BRIEF DESCRIPTION OF THE DRAWINGS

Other objects, features and advantages of the invention will be readily apparent from the following description of the preferred embodiment thereof, taken in conjunction with the accompanying drawings, although variations and modifications may be effected without departing from the spirit and scope of the novel concepts of the disclosure and in which:

FIG. 1 is a perspective view with parts broken away of a cartridge, the projectile of which is provided with the S&A mechanism of this invention;

FIG. 2 is a perspective of the housing of the S&A mechanism with the barrier in its safe position;

FIG. 3 is a plan view of the upper surface of the housing with the barrier illustrated in solid lines being its safe position and in the dashed line position being in its armed position;

FIG. 4 is a section taken on line 4—4 of FIG. 3;

FIG. 5 is a section taken on line 5—5 of FIG. 3; and

FIG. 6 is a section through the electronically initiated pyrotechnic actuator of the invention.

DESCRIPTION OF THE PREFERRED EMBODIMENT

In FIG. 1, cartridge 10 includes a case 12 filled with a suitable low explosive, or propellant, 14. Projectile, or shell, 16 is secured into case 12. Located in the base of projectile 16 is a conventional electronic fuzing system, or fuze, 18 which includes safing and arming (S&A) mechanism, or device 20. The space within casing 22 above S&A device 20 as illustrated in FIG. 1, is substantially filled with a suitable high explosive bursting charge 24.

As is best seen in FIG. 2 and 3, S&A device 20 includes a housing 26. S&A housing 26 is substantially cylindrical and has two faces, upper face 28 and lower face 30. A blow through hole 32 is formed through housing 26. Barrier cavity, or recess, 34 is formed in housing 26 and barrier 36 is pivotally mounted in cavity 34 to pivot about its pivot axis 38 between its safe position as illustrated in FIG. 3 in solid lines and its armed or second position in which the barrier 36 is rotated clockwise as illustrated by dashed lines in FIG. 3.

Detonator 40 is mounted on the lower face 30 of housing 26 in communication with blow through hole 32 and in alignment with the axis 42 of cylindrical blow through hole 32 which is also the axis of S&A housing 26 as is best seen in FIG. 4. S&A device 20 is positioned within the base of projectile 16 in close proximity to bursting charge 24 with axis 42 of blow through hole 32 substantially in alignment with spin axis 44 of projectile 16, the axis of symmetry of projectile 16.

Barrier 36 is provided with a safety arm 46 which projects from the main body of barrier 36 as is best seen in FIG. 3. Barrier latch 48 is mounted in housing 26 and is provided with a depending member, or catch 50, which engages a side wall of arm 46 to hold barrier 36 in a position in which barrier 36 blocks blow through hole 32, the status, or position, of barrier 36 when S&A device 20 is in its safe state and when barrier 36 is also in its safe position.

Set back member 52 is positioned in barrier cavity 34 between barrier 36 and housing 26 as is best seen in FIG. 4. A T-shaped set back tab 54 is formed in member 52 and is bent upwardly as seen in FIG. 4 to engage a side wall of barrier 36 to oppose rotation of barrier 36 about its pivot axis 38 from its safe position to its armed position.

Pyrotechnic actuator 56 is mounted in housing 26 under barrier latch 48 as illustrated in FIG. 5 proximate safety arm 46. Barrier latch retainer, or keeper 58, is formed integrally with housing 26. Keeper 58 holds barrier latch 48 in contact with safety arm 46 so that catch 50 will prevent barrier 36 from moving from its safe position until the arm signal is produced by fuzing system 18. The arm signal produced by fuzing system 18 causes pyrotechnic actuator 56 to explode forcing barrier latch 48 away from safety arm 46 which permits barrier 36 to pivot to its armed position. When barrier 36 is in its armed position it does not block or obstruct blow through hole 32 so that the firing train of projectile 16 which extends from detonator 40 to bursting charge 24 through S&A device 20 is completed. The power of actuator 56 is sufficient to move, or bend, barrier latch 48 to its second or armed position illustrated in dashed lines in FIG. 5.

Details of pyrotechnic actuator 58 are illustrated in FIG. 6. Base 60 has a bridge wire 62 formed on it. A sensitive explosive 64, lead styphnate, in the preferred embodiment, is positioned on base 60 in contact with bridge wire 62. Actuator 56 is also provided with a metal protective cap 66 of a suitable material such as copper.

When fuze 18 is assembled, barrier 36 is placed in its safe position blocking blow through hole 32 so that the firing train from detonator 40 to bursting charge 24 when fuze 18 is mounted in projectile 16 is not complete. Barrier 36 is held in its safe position by set back tab 54 and catch 50 of barrier latch 48. Barrier latch 48 is held in this its safe position by barrier latch retainer 58. As long as barrier 36 is in its safe position, detonation of detonator 40 no matter how caused will not result in bursting charge 24 being initiated or detonated by detonator 40, or stated another way, projectile 16 is deemed to be safe.

When projectile 16 is fired from a gun, acceleration of projectile 16 bends set back tab 54 into substantial alignment with set back member 52 so that set back tab 54 no longer opposes or prevents, barrier 36 from moving from its safe position to its armed position. As projectile 16 is accelerated linearly down the barrel of the gun from which it is fired, projectile 16 is also subjected to angular acceleration with respect to its spin axis 42 so that projectile 16 has a high angular velocity about its spin axis 42 as it leaves the barrel. The effect of this high angular velocity is to exert a significantly large force, a centrifugal force, tending to move barrier 36 from its safe position to its armed position. This force is resisted by barrier latch 48 as long as barrier latch 48 is in its safe position.

Electronic fuzing system 18 is energized by the forces to which it is subjected when projectile 16 is fired. Its timing subsystem produces timing signals so that after a predetermined period of time has elapsed from the time projectile 16 is fired, fuzing system 18 produces an arming signal. Actuator 56 is an integral part of fuzing system as is detonator 40. For additional information covering fuzing system 18 and detonator 40 reference is made to the patent application entitled "Detonator" Ser. No. 07/085,921 filed Aug. 17, 1987 further identified in the section of this application entitled "Cross Reference to Related Application". Conventional electrical circuit means cause a large electric current to flow through bridge wire 62 of actuator 56 when fuzing system 18 produces an arming signal. The current in bridge wire 62 heats the explosive 64 to its ignition point at which time it burns rapidly, or it explodes. Actuator 56 includes a sufficient amount of explosive mixture 64 to force barrier latch 48 from its safe to its armed position. As latch 48 moves to its armed position, barrier 36 is free to pivot about its pivot axis 38 from its safe to its armed position by action of centrifugal force caused by projectile 16 rotating about its spin axis 44 to complete a firing train from detonator 40 through blow through hole 32 to bursting charge 24. Thereafter, the production of a firing signal by fuzings system 18 will cause detonator 40 to detonate which in turn will cause bursting charge 24 to detonate.

S&A mechanism 20 provides dual independent safety features by using both a set back tab 54 and barrier latch 48 to retain the barrier 36 in its safe position. Latch 48 holds the barrier 36 in its safe position until after projectile 16 is fired from a gun and has traveled the desired arming distance. At that time the arming circuit of the fuzing system 18 causes a large electric current, the arming signal, to flow through bridge wire 62 of actuator 56 to initiate the lead styphnate explosive charge 64 located under barrier latch 36. The force produced by charge 64 bends barrier latch 48 clear of safety arm 46 which allows centrifugal force due to the angular velocity of projectile 16 about its spin axis 42 to move barrier 36 to its armed position.

S&A device 20 has the advantage of providing a more precise delay in arming projectile 16 while occupying a small volume. Costs of implementation are minimized because the bridge wire 62 can be formed as an integral part of electronic fuze 18.

It should be evident that various modifications can be made to the described embodiment without departing from the scope of the present invention.

What is claimed is:

1. An S&A device 20 for a spin stabilized projectile 16 having a fuzing system 18 which produces an electrical arming signal after a predetermined delay period has elapsed after the projectile 16 is fired, comprising:

a substantially cylindrical housing 26 having a longitudinal axis 42 and a first and a second face 28, 30 substantially perpendicular to the longitudinal axis 42;

a cylindrical blow through hole 32, substantially concentric with the longitudinal axis 42 of the housing 26;

a barrier recess 34 formed in one face 28 of the housing 26;

a detonator 40 mounted on the second face 30 and in communication with the blow through hole 32;

a barrier 36 pivotally mounted in the barrier recess 34, said barrier 36 having two positions, a safe position and an armed position, said barrier in its safe position blocking the blow through hole 32 and in its armed position uncovering the blow through hole 32;

a barrier latch 48 for holding the barrier in its safe position;

a pyrotechnic actuator 56 which is initiated by the arming signal produced by fuzing system 18 for bending the barrier latch 48 away from the barrier 36 to permit the barrier 36 to move by centrifugal force due to housing 26 spinning about its longitudinal axis 42 from its safe position to its armed position responsive to an arming signal being produced by the fuzing system 18.

2. An S&A device 20 as defined in claim 1 in which the barrier 36 has a safety arm 46 and the barrier latch 48 engages the safety arm 46 of the barrier 36.

3. An S&A device 20 as defined in claim 2 in which the housing 26 has a barrier latch retainer 58 for maintaining the barrier latch 48 in position to maintain the barrier 36 in its safe position.

4. An S&A device 20 as defined in claim 3 in which the barrier latch retainer 58 is formed as an integral part of housing 26.

5. A safing and arming mechanism 20 for a spin stabilized projectile 16 containing a high explosive 24 and having a fuzing system 18 which produces an electrical arming signal a predetermined period of time after the projectile 16 is fired from a gun, said projectile 16 having a longitudinal axis 44, said safing and arming mechanism 20 comprising:

an S&A housing 26 mounted in the base of the projectile 16 substantially perpendicular to the longitudinal axis 44 of the projectile 16, said housing having two faces 28, 30;

a blow through hole 32 formed through the housing 26 substantially aligned with the longitudinal axis 44 of the projectile 16;

a detonator 40 mounted on one face 30 of the housing 26 and in communication with blow through hole 32;

a barrier cavity 34 formed in the other face 28 of the housing 26;

a barrier 36 pivotally mounted in the barrier cavity 34 and having two positions one in which it blocks blow through hole 32 and a second in which barrier 36 does not block the blow through hole 32;

a barrier arm 46 projecting from the barrier 36;

a barrier latch 48 having two positions, one in which its engages the barrier arm 46 to maintain the barrier 36 in its first position and a second position in which barrier latch 48 does not prevent the barrier 36 from moving to its second position;

a set back member 52 positioned in the barrier cavity 34 between the barrier 36 and the housing 26, said set back member 52 having a set back tab 54 the set back tab 54 having two positions, the first for holding the barrier 36 in its first position and the second when the tab 54 is forced into a position in which it does not oppose movement of the barrier 36 from its first position to its second position;

an electrically initiated pyrotechnic actuator means 56 for forcing the barrier latch 48 to its second position when the electronic arming signal is produced by the fuzing system 18 of the projectile 16, centrifugal force caused by the rotation of the spin stabilized projectile 16 about its spin axis 44 after it is fired, causing the barrier 36 to move from its first to its second position when the set back tab 54 is forced into its second position and the barrier latch 48 is moved to its second position by the force of the explosion of the pyrotechnic actuator 56.

6. A safing and arming mechanism 20 as defined in claim 5 in which the S&A housing 26 is provided with a barrier latch retainer 58 to maintain the latch 48 in its first position until the electrically initiated pyrotechnic actuator means 56 is initiated by the arming signal produced by the fuzing system.

7. A safing and arming mechanism 20 as defined in claim 6 in which the electrically initiated pyrotechnic actuator means 56 includes a bridge wire 62 through which the arming signal flows to initiate the pyrotechnic actuator means 56.

8. The safing and arming mechanism 20 of claim 7 in which the pyrotechnic actuator 56 means includes a temperature sensitive material 64 in contact with bridge wire 62 which material 64 is ignited by the heat produced by the arming signal flowing through the bridge wire 62.

9. The safing and arming mechanism of claim 8 in which the temperatrue sensitive material is lead styphnate.

10. In a spin stabilized projectile 16 having an axis of rotation 44, a casing 22 containing a high explosive bursting charge 24, a fuzing system 18 for producing an electrical arming signal a predetermined period of time after the projectile 16 is fired from a gun having a rifled barrel and an electrical firing signal, the improvements comprising:

a substantially cylindrical S&A housing 26 having two faces 28, 30 mounted in the casing 22, a first face 28 of the housing 26 in communication with the bursting charge 24, the faces of the housing being substantially perpendicular to the axis of rotation 44 of the projectile 16;

a blow through hole 32 formed through the housing 26, the axis 42 of the blow through hole 32 being substantially aligned with the axis of rotation 44 of projectile 16;

an electronically initiated detonator 40 mounted on the second face 30 of housing 26 remote from the bursting charge 24 and in communication with the blow through hole 32;

a barrier cavity 34 formed in the first face 28 of the housing 26;

a barrier 36 pivotally mounted in barrier cavity 34 with respect to a pivot axis 38, said barrier 36 having two positions, a first position in which the barrier 36 blocks the blow through hole 32 and a second position in which the barrier 36 is clear of the blow through hole 32;

a barrier arm 46, projecting from the barrier 36 and positioned remotely with respect to the pivot axis 38 of barrier 36;

a barrier latch 48 mounted in housing 26 and having a first position and a second position, said barrier latch 48 in its first position engaging barrier arm 46 to prevent barrier 36 from moving from its first position to its second position, said barrier latch 48 in its second position being disengaged from barrier arm 46 to permit barrier 36 to pivot to its second position;

electrically initiated pyrotechnic actuator means 56 mounted in housing 26 for forcing barrier latch 48 from its first position to its second position responsive to an electrical arming signal being produced by the fuzing means 18 and being applied to the actuator means 56 whereby detonator 40 is in communication with the bursting charge 24 of projectile 16 and detonation of detonator 40 by a firing signal produced by the fuzing system will cause the bursting charge 24 to detonate.

11. In the spin stabilized projectile 16 defined in claim 10 in which the S&A housing 26 is provided with a barrier latch keeper 58 which maintains the barrier latch 48 in its first position until the pyrotechnic actuator means 56 is initiated.

12. In the spin system stabilized projectile 16 defined in claim 11 in which the barrier latch keeper 58 is an integral part of the S&A housing 26.

13. In the spin stabilized projectile 16 defined in claim 12 in which the electrically initiated pyrotechnic actuator means 56 includes a bridge wire 62 and a temperature sensitive material 64 in contact with the bridge wire 62, said temperature sensitive material being ignited by heat produced when the electrical current of the arming signal flows through the bridge wire 62.

14. In the spin stabilized projectile 16 defined in claim 13 in which the temperature sensitive material 64 is lead styphnate.

* * * * *